United States Patent [19]

Rainwater

[11] 4,195,270

[45] Mar. 25, 1980

[54] DIELECTRIC SLAB POLARIZER

[75] Inventor: Lawrence L. Rainwater, Salt Lake City, Utah

[73] Assignee: Sperry Corporation, New York, N.Y.

[21] Appl. No.: 910,327

[22] Filed: May 30, 1978

[51] Int. Cl.[2] ..... H01P 1/16

[52] U.S. Cl. ..... 333/21 A; 333/34

[58] Field of Search ..... 333/21 R, 21 A, 24.1, 333/34, 24.3; 343/756

[56] References Cited

U.S. PATENT DOCUMENTS

| | | | |
|---|---|---|---|
| 2,858,512 | 10/1958 | Barnett | 333/31 A |
| 3,080,536 | 3/1963 | Dewhirst | 333/24.1 |
| 3,216,017 | 11/1965 | Moore | 333/34 X |

OTHER PUBLICATIONS

Ayres, *Broad-Band Quarter-Wave Plates*, IRE Trans. on MTT, Oct. 1957, pp. 258-261.

*Primary Examiner*—Paul L. Gensler

*Attorney, Agent, or Firm*—John P. Dority; William E. Cleaver; Marshall M. Truex

[57] ABSTRACT

A dielectric slab polarizer employs a unique configuration which provides improved impedance matching of the polarizer to the empty space of a waveguide section and, thereby, allows an approximate ninety degree differential phase shift transformation of RF field polarization to be achieved over a wider frequency bandwidth than heretofore attainable. The novel configuration of the slab polarizer is embodied by a flat middle section, conical tapered opposite end sections and reverse tapered intermediate sections which merge with the flat middle section and opposite end sections. The regions of merger between the respective intermediate sections and opposite end sections have a thickness greater than that of the middle section.

7 Claims, 9 Drawing Figures

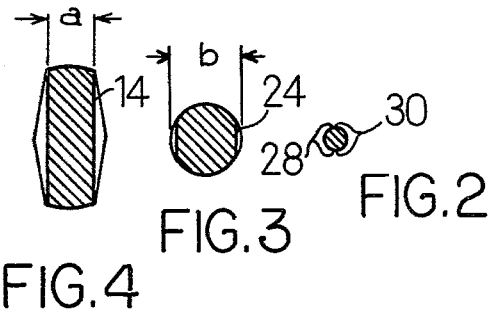
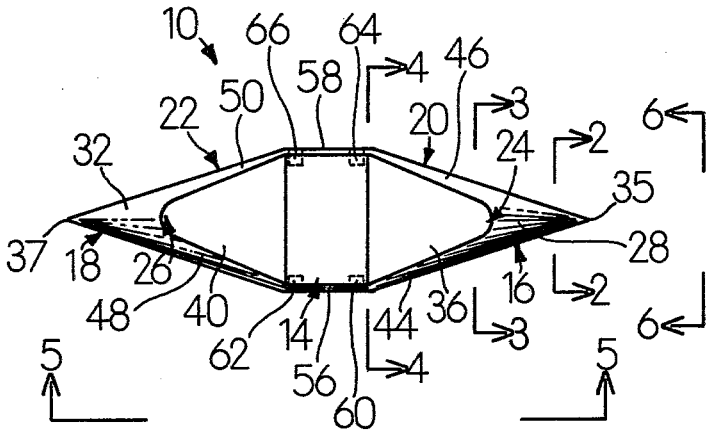
FIG. 1
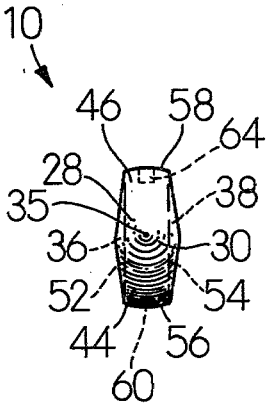
FIG. 6
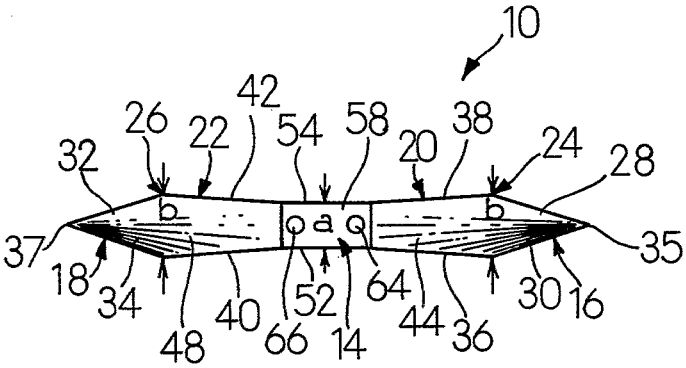
FIG. 5

DIELECTRIC SLAB POLARIZER

The Government has rights in this invention pursuant to Contract No. F33657-75-C-0276 awarded by the Department of the Air Force.

BACKGROUND OF THE INVENTION

1. FIELD OF THE INVENTION

The present invention broadly relates to the transformation of RF energy field polarization in waveguide structures and, more particularly, is concerned with a dielectric slab polarizer having a novel configuration which, when the polarizer is installed in a waveguide section, provides improved impedance matching of the polarizer to the empty space of the waveguide section whereby improved transformation of RF field polarization is achieved over a wider frequency bandwidth than heretofore attained.

2. DESCRIPTION OF THE PRIOR ART

Transformation of an RF energy field from linear to circular polarization or vice versa through use of some form of a quarter-wave dielectric slab polarizer has been described in literature. See for exmaple, an article entitled "Broad-Band Quarter-Wave Plates" by Wesley P. Ayres, appearing at pages 258–261 of the October 1957 issue of the *IRE Transactions on Microwave Theory and Technique* Journal. Also, U.S. Pat. No. 3,858,512 which issued Oct. 28, 1958, to Edward F. Barnett, describes the use of a pair of quarter-wave dielectric slabs with a half-wave dielectric slab in an assembly for providing transformation of RF field polarization.

The theoretical broad frequency bandwidth characteristics of thick dielectric slab polarizers are well known, as recognized in the Ayres article. However, the problem of impedance matching of the thick slab to the empty space within a square or round waveguide section has prevented full realization of the theoretical bandwidth. Impedance mismatching causes unequal reflections of the two orthogonal RF field components of an electric field from the ends of the slab which increases the axial ratio to unacceptable levels and thereby limits the operating bandwidth.

This problem of reflection due to mismatching is discussed by Ayres and, as he suggests, conventional practice in slab polarizer construction is to build a quarter-wave plate having a thickness at its midsection of only about one-half of that corresponding to the optimum slab thickness to waveguide diameter ratio for the theoretical bandwidth so that the opposite ends of the plate may be provided with gradually tapered configurations which minimize the reflection problem. If a plate of optimum midsection thickness and tapered ends were utilized, the ends would have steeply tapered configurations. As found by Ayres, steep tapers, for example at an angle of almost forty-five degrees to the incident field, produce so much reflection that the slab would be useless as a quarter-wave plate.

Also, in the conventional slab construction having a midsection thickness of one-half the optimum, it has been found that most or all of the required ninety degree differential phase shift of the field components occurs within the gradual tapered end sections of the slab. Therefore, it is not feasible merely to increase the length of the tapered ends in order to combine the gradual tapered configuration of the ends with a slab midsection of optimum thickness since this would produce too much differential phase shift.

SUMMARY OF THE INVENTION

The dielectric slab polarizer of the present invention employs a novel configuration which provides improved impedance matching of the polarizer to the empty space of a waveguide section, allowing an approximate ninety degree differential phase shift transformation of RF field polarization to be achieved over a wider frequency bandwidth than heretofore attained. The novel geometrical configuration of the slab polarizer, in its preferred form, is embodied by a flat middle section, conical tapered opposite end sections and reverse tapered intermediate sections which merge with the flat middle section and opposite end sections. The regions of merger between the respective intermediate sections and opposite end sections have a thickness greater than that of the middle section, such thickness being of a dimension on the order of that theoretically prescribed, but heretofore not attained in practice, by the optimum slab thickness to waveguide diameter ratio for the slab midsection in the Ayres article. Optimum thickness to diameter ratio for broadest bandwidth was given in the Ayres article as 0.375 to 0.400.

The problem of internal reflections, which heretofore has prevented use of an optimum thickness slab and realization of its theoretical broad frequency bandwidth characteristics, has been overcome by the unique configuration of the slab polarizer of the present invention. Specifically, with the slab polarizer disposed within a waveguide section and aligned at forty-five degrees to the incident RF electric field, the conical tapered end sections transform most of the two orthogonal RF field components of the electrical field into the dielectric material of the slab with low but equal reflections and zero differential phase shift. Then, the gradual reverse slope taper of the intermediate sections completes the transformation of one of the field components into the flat middle section of the slab. The differential phase shift of the field components increases gradually, but reflections produced from the reverse taper intermediate sections and the continuation of the conical taper end sections along the sides of the intermediate sections tend to oppose one another and cancel out and, thus, have little effect upon the axial ratio characteristic of the polarizer.

The configuration of the present invention provides a wideband slab polarizer with very low VSWR. One constructed embodiment had a low axial ratio from a frequency bandwidth of 8.2 to 12.4 GHz., with a measured VSWR less than 1.18:1 over the same frequency band. This is believed to surpass the performance characteristics of polarizer configurations proposed in the prior art.

BRIEF DESCRIPTION OF THE DRAWINGS

FIG. 1 is a side elevation view of the improved dielectric slab polarizer of the present invention.

FIG. 2 is an enlarged cross-sectional view taken along line 2—2 through one of the conical tapered opposite end sections of the polarizer of FIG. 1.

FIG. 3 is an enlarged cross-sectional view taken along line 3—3 through the region of merger of one of the reverse tapered intermediate sections with an adjacent one of the opposite end sections of the polarizer of FIG. 1.

FIG. 4 is an enlarged cross-sectional view taken along line 4—4 through the middle section of the polarizer of FIG. 1.

FIG. 5 is a plan view of the polarizer as seen along line 5—5 of FIG. 1.

FIG. 6 is an end elevational view of the polarizer as seen along line 6—6 of FIG. 1.

DETAILED DESCRIPTION OF THE INVENTION

Figure 9:
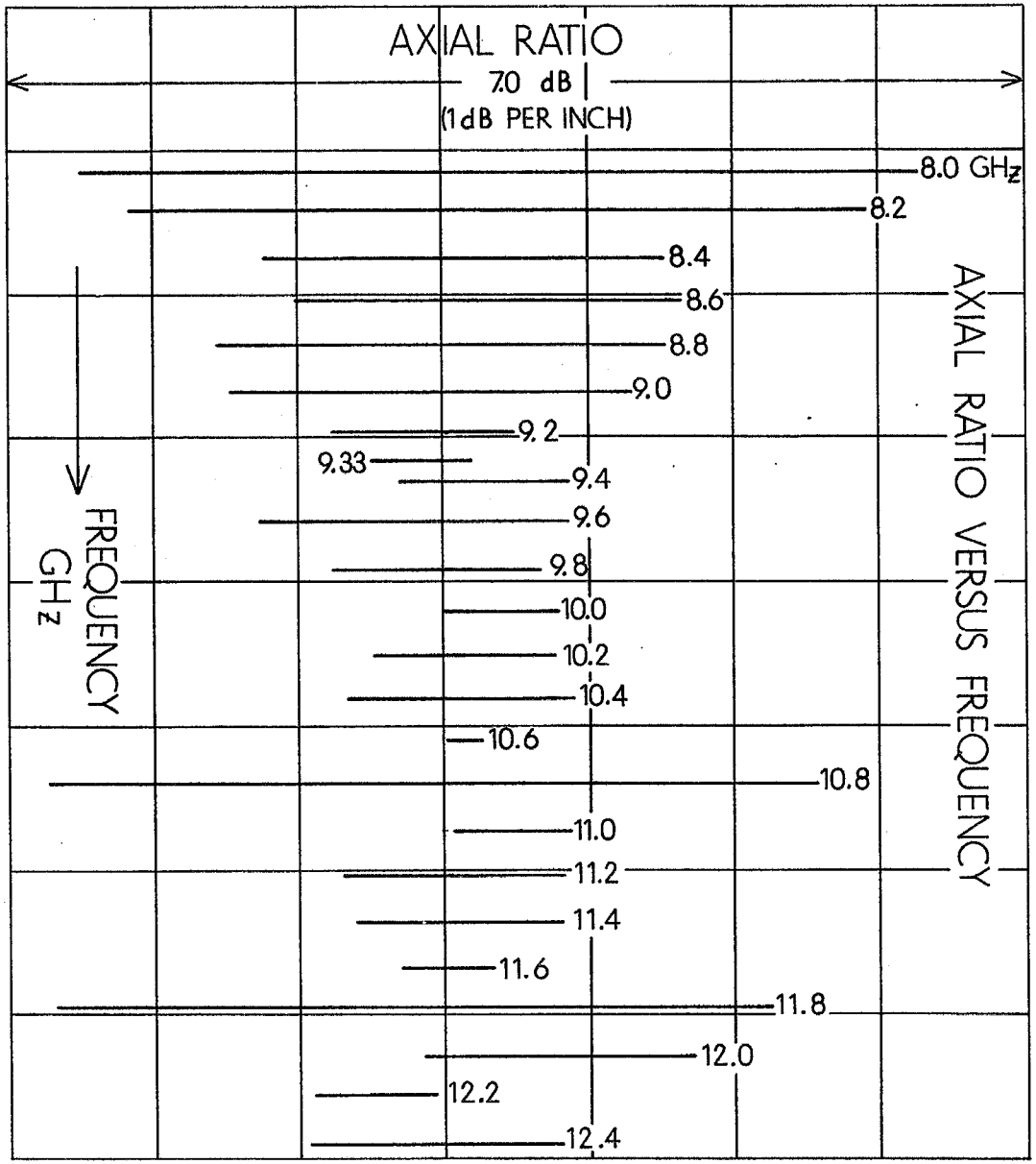
FIG. 9 is a graph of the axial ratio versus frequency for one constructed embodiment of the polarizer of FIG. 1.

Referring now to the drawings, and more particularly to FIGS. 1 and 5, there is shown the preferred embodiment of the improved dielectric slab polarizer of the present invention, being generally designated 10. The polarizer 10 employs a unique configuration which, when the polarizer 10 is installed in a waveguide section 12 (FIGS. 7 and 8), provides improved impedance matching of the polarizer 10 to the empty space within the waveguide section 12.

The configuration of the slab polarizer 10 is embodied by a middle section 14, a pair of outer end sections 16 and 18 and a pair of intermediate sections 20 and 22. As shown, each of the intermediate sections 20, 22 is disposed between and merges with the middle section 14 and an adjacent one of the outer end sections 16, 18.

The middle section 14 is rectangular in shape, while the outer end sections 16, 18 and intermediate sections 20, 22 have different tapered configurations. As best seen in FIGS. 3, 4 and 5, the thickness of the middle section 14, dimension "a", is less than the thickness, dimension "b", of each of the regions of merger, generally designated 24 and 26, of the adjacent intermediate and outer end sections 20, 16 and 22, 18.

The outer end sections 16, 18 have respective pairs of opposite arcuate surface portions 28, 30 and 32, 34, as seen in FIG. 5 and partially in FIGS. 1 and 6, which divergently taper from outer edges or tips 35, 37 of the respective sections 16, 18 to first pairs of opposite sides of the adjacent intermediate sections 20, 22. Each of the pairs of opposite surface portions 28, 30 and 32, 34 provides the outer end sections 16, 18 with identical conical configurations. See the cross section of FIG. 2 taken through the outer end section 16 which illustrates the semicircular cross-sectional profile of the opposite surface portions 28, 30 of the outer end section 16.

The intermediate sections 20, 22 have respective first pairs of opposite planar surface portions 36, 38 and 40, 42 at their respective first pairs of opposite sides, as seen in FIG. 5 and partially in FIGS. 1 and 6, which merge with the respective arcuate surface portions 28, 30 and 32, 34 of the adjacent outer end sections 16, 18 and convergently taper therefrom to a first pair of opposite sides of the middle section 14. It will be observed that the first pairs of opposite planar surface portions 36, 38 and 40, 42 of the intermediate sections merge with the respective opposite arcuate surface portions 28, 30 and 32, 34 of the adjacent outer end sections 16, 18 at their respective regions of merger 24, 26 which are the regions of maximum thickness of the polarizer 10. Therefore, the slope of the surface portions of the intermediate sections are reverse to that of the corresponding surface portions of the outer end sections. Also, the peripheral boundary of each of the planar surface portions 36, 38 and 40, 42 has a parabolic configuration, as seen in FIG. 1 with respect to surface portions 36 and 40.

The intermediate sections 20, 22 also have respective second pairs of opposite arcuate surface portions 44, 46 and 48, 50 at respective second pairs of opposite sides of the sections 20, 22 as seen in FIG. 1 and partially in FIGS. 5 and 6, which form extensions from the pairs of opposite surface portions 28, 30 and 32, 34 of the outer end sections 16, 18 to a second pair of opposite sides of the middle section 14.

Figure 8:
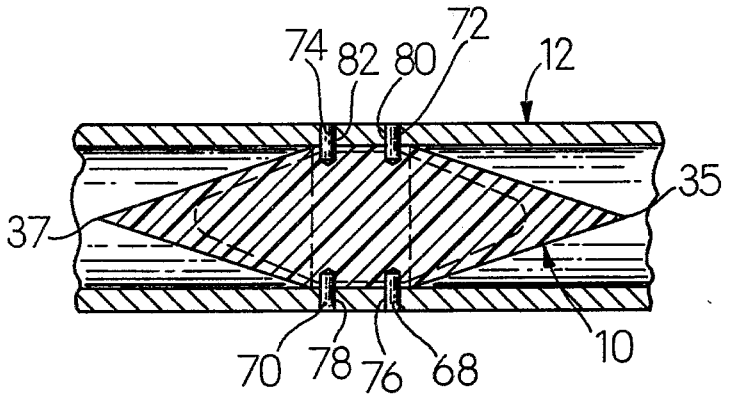
FIG. 8 is a cross-sectional view taken along line 8—8 of FIG. 7.
Figure 7:
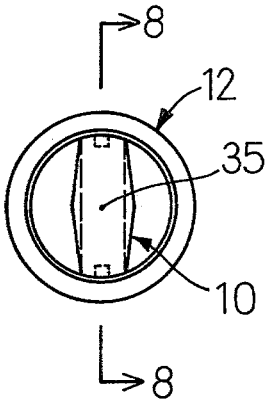
FIG. 7 is an end elevational view of the polarizer of FIG. 1 installed in a waveguide section.

The above-mentioned first pair of opposite sides of the middle section 14 is defined by opposite planar surfaces 52, 54 while its above-mentioned second pair of opposite sides is defined by opposite curved surfaces 56, 58. The latter surfaces 56, 58 of the middle section 14 have a curved shape adapted to conform to the curvature of the interior cylindrical surface of the waveguide section 12, as seen in FIGS. 7 and 8, when installed therein. If the waveguide section were of square cross-sectional shape, then the surfaces 56, 58 would have a right angle shape or be flat depending upon whether the polarizer is mounted diagonally or transversely between the flats of the square waveguide section. The middle section 14 also includes pairs of spaced apart bores 60, 62 and 64, 66 formed therein and opening at its curved surfaces 56 and 58, respectively, for receiving fasteners 68, 70 and 72, 74, being formed of the same dielectric material as that of the polarizer 10, to secure the polarizer 10 within the waveguide section 12. It will be noted in FIG. 8 that the fasteners 68, 70 and 72, 74 are also anchored within opposing bores 76, 78 and 80, 82 formed through the waveguide section 12 with which the bores 60, 62 and 64, 66 of the polarizer 10 are respectively aligned when the polarizer 10 is installed in the waveguide section 12.

In summary, therefore, the slab polarizer 10 is symmetrically configured by the unique arrangement of the rectangular middle section 14 with the conical tapered outer end sections 16, 18 and the intermediate sections 20, 22, as seen in FIGS. 1, 5 and 6, with planar surface portions 36, 38 and 40, 42 of the intermediate sections 20, 22 having reverse tapered slopes as compared to the conical taper of the outer end sections 16, 18 since the regions of merger 24, 26 of the outer end and intermediate sections 16, 20 and 18, 22 are greater in thickness than that of the middle section 14. The polarizer 10 is symmetrical in the sense that the outer end section 16 and intermediate section 20 form a mirror image of the outer end section 18 and intermediate section 22. Thus, a view of the polarizer 10 from the side opposite to that shown in FIG. 1 would be identical to that of FIG. 1; a plan view of the polarizer 10 opposite to that of FIG. 5 would be identical to that of FIG. 5; and, an end view of the polarizer 10 opposite to that of FIG. 6 would be identical to that of FIG. 6.

One practical example of the dielectric slab polarizer 10 has the following dimensions and is made of dielectric material purchased from Emerson Cuming, Inc., designated by the reference HT0003, which is basically a foamed thermoset Teflon material having a dielectric constant of 2.2. The thickness "b" of the regions of merger 24, 26 is 0.415 inch, while the thickness "a" of the rectangular middle section 14 is 0.300 inch. The axial length of the polarizer 10 from tip to tip is 3.500 inches. The axial length of the planar surfaces 52, 54 of the middle section 14 is 0.550 inch, while the axial length of its curved surfaces 56, 58 is 0.600 inch. The width of the polarizer 10 at its middle section 14 is 0.935 inch. Each of the conical outer end sections 16, 18 has an axial length of 0.644 inch. Each of the intermediate sections 20, 22 has an axial length of 0.831 inch. The respective bores 60, 62 and 64, 66 are spaced 0.437 inch apart, and each has a diameter of about 0.094 inch and depth of 0.093 inch. The angle of each of the planar surfaces 36, 38 and 40, 42 of the intermediate sections 20, 22 is approximately four degrees, while the angle of each of the surfaces 28, 30 and 32, 34 of the conical outer end sections 16, 18 is approximately eighteen degrees. Each of the above-mentioned angles is in reference to the longitudinal axis of the polarizer 10.

The realization that the reverse tapered surfaces 36, 38 and 40, 42 of the intermediate sections 20, 22 and the regions of merger 24, 26 in the polarizer 10 of the present invention would provide better impedance matching and the required differential phase shift over a wider frequency band is the primary discovery by this inventor. The particular thickness of the regions of merge and the particular angle of the reverse tapered surfaces in the above-described one example of the polarizer of the present invention were determined empirically because the curves depicted in FIG. 4 of the Ayres article do not extend to the greater normalized thickness required by this invention.

The above dimensions of one example of the slab polarizer 10 are based on use of the polarizer with a cylindrical waveguide section having an internal diameter of 0.937 inch selected to transmit I-band frequencies. The same polarizer dimensions would hold for an equivalent square wavequide section. The polarizer dimensions would be different when it is designed for use in waveguide sections having other diameters for transmitting other frequency bands. However, the unique overall configuration of the polarizer would be the same.

FIG. 9 illustrates a graph which was prepared from data measurements made during a test conducted on the above-described one practical embodiment of the polarizer 10. The high axial ratio measured at 10.8 and 11.8 GHz. was observed to be caused by moding in the waveguide rotary joint which was used to make the measurement. Acceptable axial ratio limits for determining the bandwidth of the polarizer is about 3 dB. Based on this criteria and disregarding the abnormalities which occurred at 10.8 and 11.8 GHz., the graph of FIG. 9 demonstrates that this one practical embodiment of the polarizer 10 has an acceptable axial ratio over nearly all of the 8.4 to 12.4 GHz. bandwidth. This axial ratio is better than that described in the Ayres article over a similar bandwidth.

Having thus described the invention, what is claimed is:

1. In a waveguide section, an improved dielectric slab polarizer for providing an approximate ninety degree differential phase shift transformation of RF field polarization, comprised by:

a rectangular polyhedron middle section;

a pair of conical opposite end sections tapered to converge away from said middle section and spaced along the axis of said waveguide section; and a pair of intermediate sections convergently tapered toward said middle section which merge with said middle section and said opposite end sections.

2. The polarizer as recited in claim 1, wherein regions of merger between said intermediate sections and said opposite end sections have a thickness greater than that of said middle section.

3. In a waveguide section, an improved dielectric slab polarizer for transforming a linearly polarized RF field into a substantially circular polarized RF field or vice versa, comprised by:

a rectangular polyhedron middle section;

a pair of intermediate sections integrally connected with and extending from opposite ends of said middle section; and a pair of outer end sections spaced along the axis of said waveguide section, each outer end section being integrally connected with and extending from a respective one of said intermediate sections such that said polarizer is symmetrically configured with said integrally connected intermediate and outer end sections at one end of said middle section forming a mirror image of said integrally connected intermediate and outer end sections at the other end of said middle section;

said outer end sections each including opposite surface portions which divergently taper from an outer tip to the integrally connected one of said pair of intermediate sections;

said intermediate sections each including opposite surface portions which convergently taper from said integrally connected one of said pair of outer end sections to said middle section.

4. The polarizer as recited in claim 3, wherein each of said intermediate sections and said outer end sections have a region which has a thickness greater than the thickness of said middle section.

5. The polarizer as recited in claim 3, wherein said opposite surface portions of each of said outer end sections provide said each outer end section with a tapered conical configuration.

6. In a waveguide section, an improved dielectric slab polarizer for transforming a linearly polarized RF field into a substantially circularly polarized RF field or vice versa, comprised by:

a pair of outer end sections spaced along the axis of said waveguide section;

a middle section; and a pair of intermediate sections, each being disposed between and merging with said middle section and an adjacent one of said outer end sections, said each adjacent intermediate section and outer end section at their region of merger being greater in thickness than said middle section;

said each outer end section having opposite surface portions which divergently taper from an outer edge of said section to opposite sides of said adjacent one of said intermediate sections;

said each intermediate section having opposite surface portions at its opposite sides which merge with said surface portion of said adjacent one of said outer end sections and convergently taper therefrom to opposite sides of said middle section.

7. The polarizer as recited in claim 6, wherein said each intermediate section has additional opposite surface portions which form extensions from said opposite surface portions of said adjacent one of said outer end sections, divergently tapering to said middle section and interconnecting said convergently tapered opposite surface portions of said intermediate section.

* * * * *